US006508396B1

(12) United States Patent
Chan

(10) Patent No.: US 6,508,396 B1
(45) Date of Patent: Jan. 21, 2003

(54) TABLE TOP DISPLAY DEVICES

(75) Inventor: Sik-Leung Chan, Tsuen Wan (HK)

(73) Assignee: C. C. & L Company Limited, Tsuen Wan (HK)

( * ) Notice: Subject to any disclaimer, the term of this patent is extended or adjusted under 35 U.S.C. 154(b) by 89 days.

(21) Appl. No.: 09/618,770

(22) Filed: Jul. 18, 2000

(51) Int. Cl.[7] ..... G06C 23/00
(52) U.S. Cl. ..... 235/61 R; 235/61 R
(58) Field of Search ..... 235/61 R

(56) References Cited

U.S. PATENT DOCUMENTS 5,835,343 A 11/1998 Johns et al. ..... 361/681
5,923,870 A 7/1999 Johns et al. ..... 713/502
6,011,544 A 1/2000 Sato ..... 235/61 R
6,144,368 A 11/2000 Ooka et al. ..... 345/157
6,154,261 A 11/2000 Shim ..... 349/151

FOREIGN PATENT DOCUMENTS

JP 411249763 A 9/1999

*Primary Examiner*—Karl D. Frech
*Assistant Examiner*—Allyson Sanders
(74) *Attorney, Agent, or Firm*—Alix, Yale & Ristas, LLP

(57) ABSTRACT

A desk top calculator device is supported in a window frame 13 of a casing which includes the window frame and a housing 14. In an "open" configuration shown in the Figure, a keyboard 11 is exposed for use. The keyboard slides into the housing in a "closed" configuration of the device to avoid exposure and/or damage to the keyboard when the device is not in use.

4 Claims, 4 Drawing Sheets

TABLE TOP DISPLAY DEVICES

BACKGROUND OF THE INVENTION

1. Field of the Invention

The invention relates to table top display devices.

2. Description of Prior Art

The invention relates more particularly to cases for such devices which are useful in incorporating the devices and providing additional features for the devices. Such devices may include any relatively small device that has a visible screen upstanding for indicating time-of-day, room temperature, letter or numerals or pictures on an LCD for example that are used on a desk, bed-side table and the like. Presently such devices usually have one single function and where a keyboard may be used for operating the device the keyboard remains exposed, and possibly vulnerable to accidental damage at all times.

SUMMARY OF THE INVENTION

It is an object of the invention to reduce or overcome these problems.

According to the invention there is provided a table top display device casing having a movable generally upstanding window frame for receiving an LCD of the device, and the casing including a housing with a horizontal base, an open sloping front aperture against which the window frame fits, a rear panel and a base, in which the window frame is pivotably supported centrally to the housing to allow the frame to swing away from the front aperture between two positions, a first position where the frame fits against the aperture and obscures the aperture and a second position, above the first position, where the frame fits against the aperture and obscures a portion of the aperture, a platform normally mounted inside the housing below the window frame and slidable generally horizontally on the base, a mechanically linking member extending from a pivotable connection adjacent a rear of the platform and pivotable connection to a lower part of the window frame, and an intermediate pivotable connection between the linking member mounted inside the housing and positioned forward of the rear panel, such that when the window frame moves from the first position to the second position the platform is moved substantially out of the housing by the linking member.

Spring biassing means may be provided for biassing the window frame to the second position and a manually releasable latch to hold the window frame in the first position against the spring bias.

The spring biassing means may be mounted to the intermediate pivotable connection.

The platform may carry a keyboard that become accessible for the user when the window frame is in the second position.

BRIEF DESCRIPTION OF THE DRAWINGS

A table top display device according to the invention will now be described by way of example with reference to the accompanying drawings in which.

DESCRIPTION OF THE PREFERRED EMBODIMENT

Figure 2:
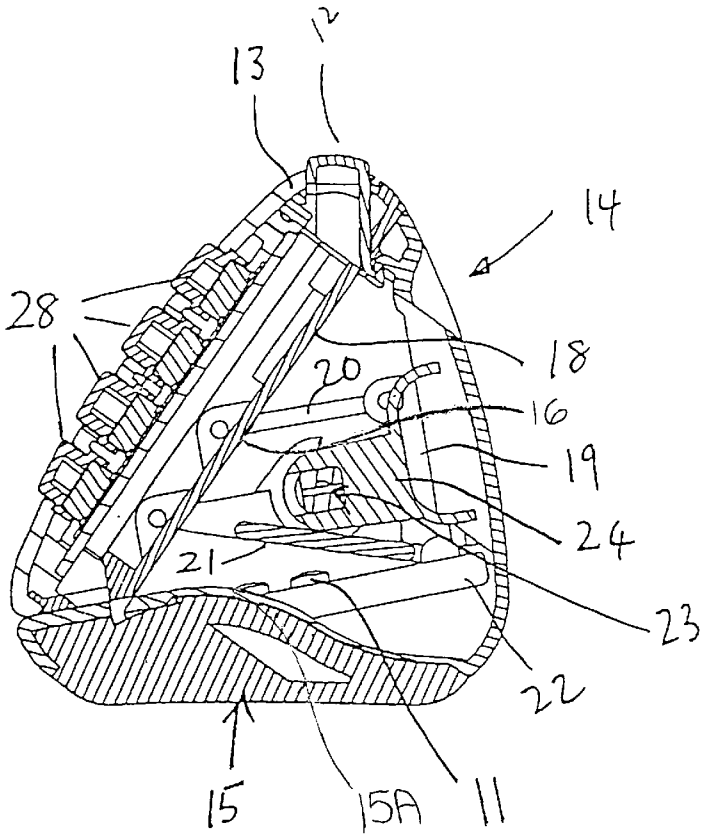
FIG. 2 is a sectional view of the device along section lines A—A shown in FIG. 1.
Figure 1:
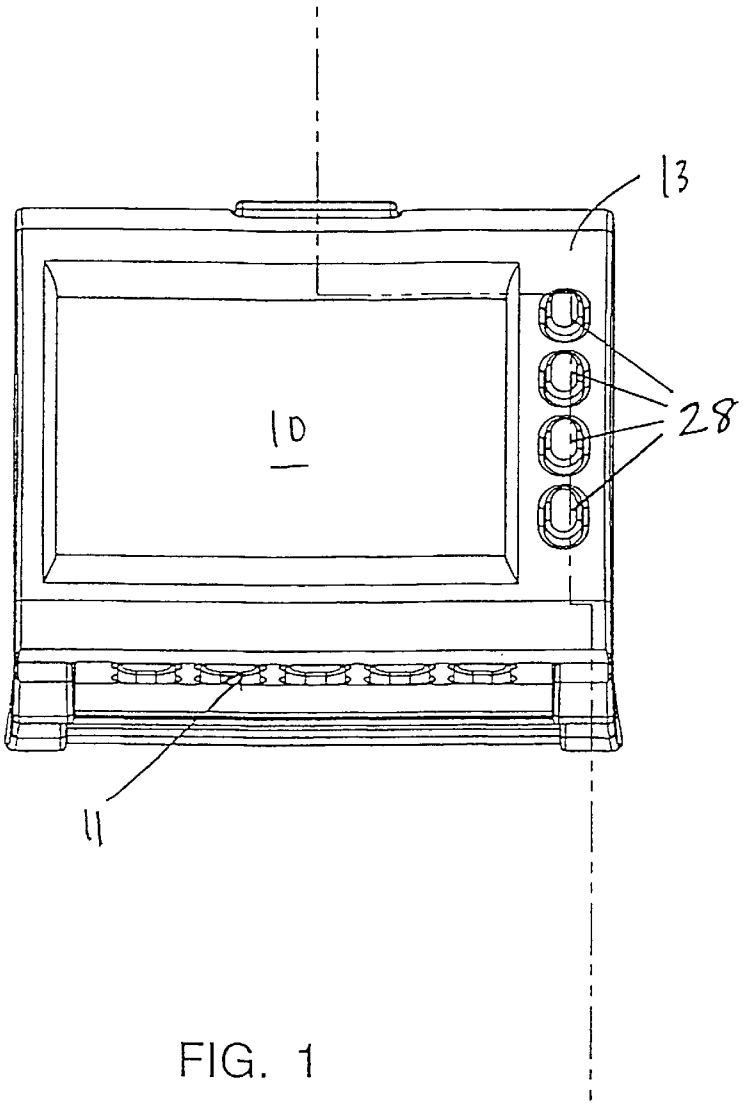
FIG. 1 is a front view of the device in a first configuration with a window frame in a first position.
Figure 7:
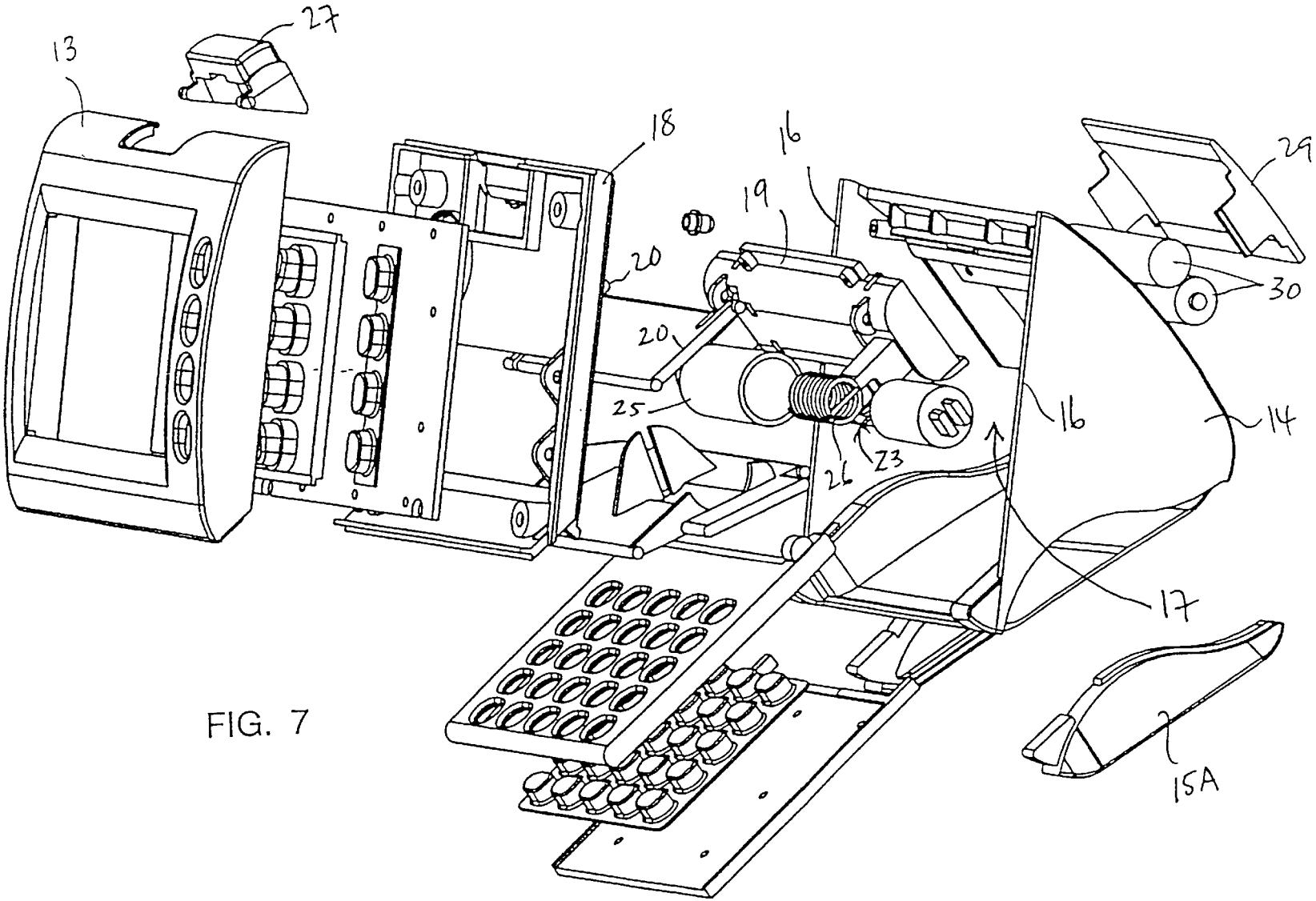
FIG. 7 is an exploded isometric view of the device.

Referring to the drawings, in FIGS. 1 and 2 the device comprises a calculator that has a LCD 10 and a keyboard 11 which are supported in a casing 12. The casing has a generally upstanding front window frame 13, for the LCD 10, and a hollow housing 14 with a horizontal base 15. The frame 13 fits against sloping sides 16 (see FIG. 7) of the housing and normally obscures (as in FIGS. 1 and 2) an opening 17 (see FIG. 7) formed in a front of the housing 14.

A rear panel 18 of the frame 13 is pivotably supported centrally to an anchor plate 19 fixed to a rear panel of the housing 14 by supporting members 20. The supporting members 20 allow the window frame 13 to swing upwards and away from the sides 16 from a first position shown in FIGS. 1 and 2 to a second position shown in FIGS. 3 and 4 where the window frame only partially obscures the opening 17. In this embodiment, the opening 17 is in fact always obscured from view in front of the device by a mechanical linking member 21.

As shown clearly in FIG. 2, the linking member 21 is pivotably connected to a lower part of the window frame panel 18 and pivotably connected to a rear of a platform 22 that is slidable generally horizontally on the base sliders 15A. Intermediate pivotable connections 23 are positioned between the anchor plate 19 and the linking member 21, by an anchor mountings 24. This means that a pivoting axis for the intermediate pivotable connections 23 is positioned inside the housing 14 but forward of the anchor plate 19. As a result when the window frame moves from the first position shown in FIGS. 1 and 2 to the second position shown in FIGS. 3 and 4, the platform 22 (which supports the keyboard 11) is moved from inside the housing 14 to substantially out of the housing.

Figure 6:
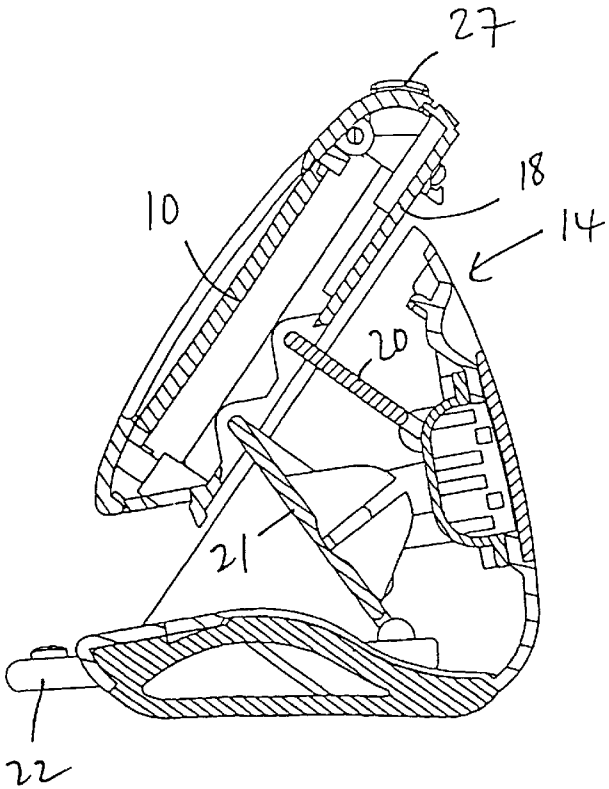
FIG. 6 is a sectional view of the device along section lines C—C shown in FIG. 5.
Figure 5:
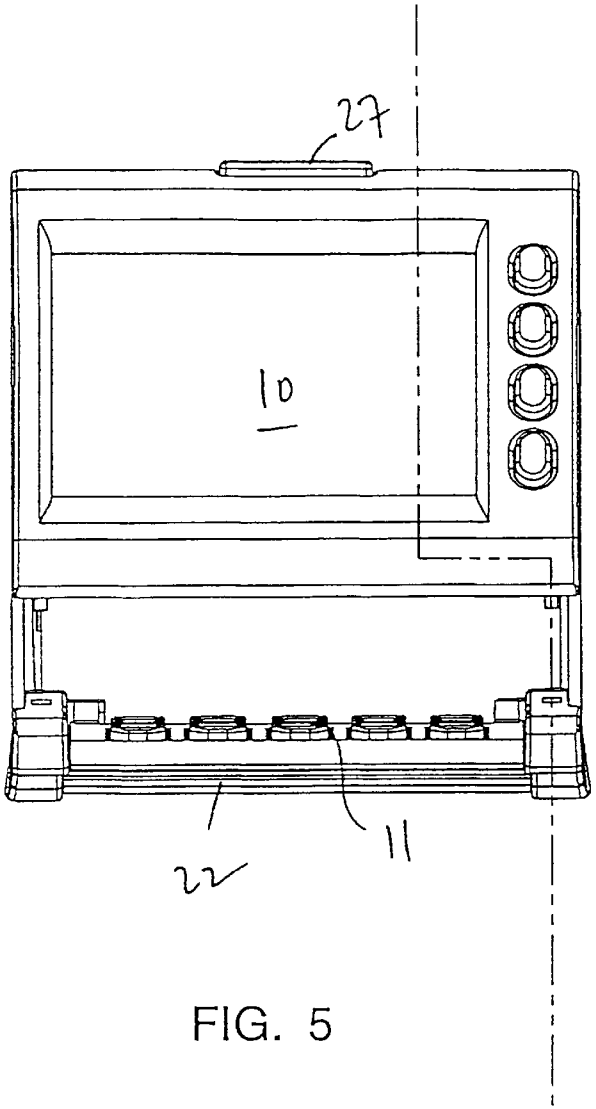
FIG. 5 is a front view of the device in an intermediate configuration.

An intermediate configuration of the device, where the window frame is between the first position and the second position, is shown in FIGS. 5 and 6.

Figure 4:
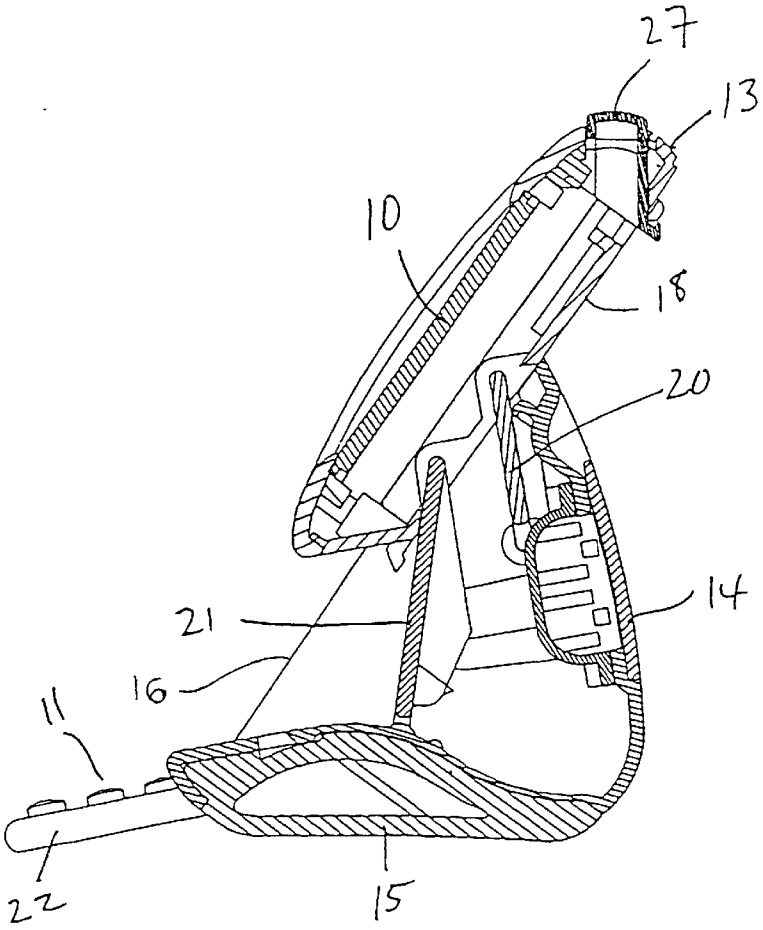
FIG. 4 is a sectional view of the device along section lines B—B shown in FIG. 3.
Figure 3:
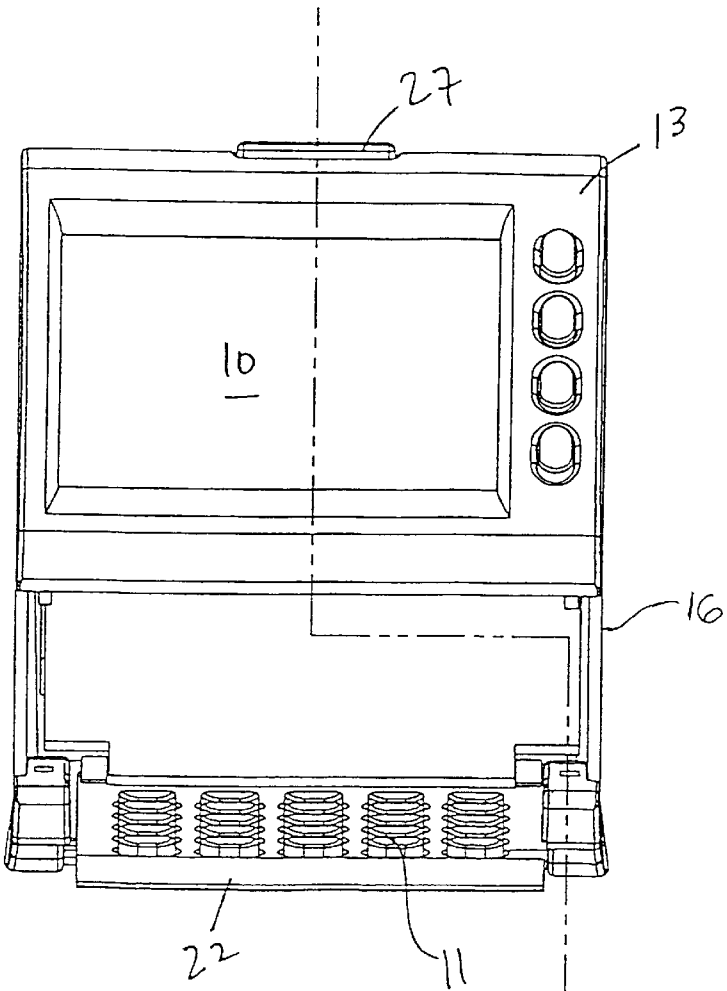
FIG. 3 is a front view of the device in a second configuration with the window frame in a second position.

Associated with the intermediate connections 22 is a housing 25 that embraces a coil spring 26 that is wound up by relative movement of the panel 18 and the housing 14, when the window frame is moved to the first position shown in FIGS. 1 and 2 from the second position shown in FIGS. 3 and 4. Bias provided by the spring then acts to move the window frame automatically to the second position when a manually operated latch 27 is manually released.

The frame member 13 is provided with four push-buttons 28 that are used to operate functions of the device, and includes an ON-OFF button for example. A battery compartment cover 29 is provided for containing two batteries 30 in the housing 14.

The described device is a calculator but other devices may be mounted in the housing, such as a thermometer, an alarm clock and so forth. As when an alarm clock, say, is provided the LCD 10 normally used for indicating time-of-day, alarm settings, and so forth, may be also used for calculations by selecting a calculator function.

In other applications, the platform 22 may be used to support or carry functional or control buttons that may be required to play a game displayed on the LCD. The platform may also be used simply to provide a storage tray for clerical use, such as pins or paper clips. In all cases, as the platform is normally positioned completely within the housing 14, the keyboard, control buttons or stored articles are held securely and unlikely to be damaged or blatantly exposed, except when required.

I claim:

1. A table top display device casing having a movable generally upstanding window frame for receiving an LCD of the device, and the casing including a housing with a horizontal base, an open sloping front aperture against which the window frame fits, a rear panel and a base, in which the window frame is pivotably supported centrally to the housing to allow the frame to swing away from the front aperture between two positions, a first position where the frame fits against the aperture and obscures the aperture and a second position, above the first position, where the frame fits against the aperture and obscures a portion of the aperture, a platform normally mounted inside the housing below the window frame and slidable generally horizontally on the base, a mechanically linking member extending from a pivotable connection adjacent a rear of the platform and pivotable connection to a lower part of the window frame, and an intermediate pivotable connection between the linking member mounted inside the housing and positioned forward of the rear panel, such that when the window frame moves from the first position to the second position the platform is moved substantially out of the housing by the linking member.

2. A table top display device casing according to claim 1, including spring biassing means for biassing the window frame to the second position and a manually releasable latch to hold the window frame in the first position against the spring bias.

3. A table top display device casing according to claim 2, in which the spring biassing means is mounted to the intermediate pivotable connection.

4. A table top display device casing according to claim 1, in which the platform carries a keyboard that become accessible for the user when the window frame is in the second position.

* * * * *